United States Patent [19]

Dorn

[11] 3,935,560

[45] Jan. 27, 1976

[54] LIGHT GUARD

[76] Inventor: Harry M. Dorn, 1133 Broadway, New York, N.Y. 10010

[22] Filed: Nov. 13, 1974

[21] Appl. No.: 523,398

[52] U.S. Cl. ..... 240/102 B; 240/54 A

[51] Int. Cl.[2] ..... F21V 15/00

[58] Field of Search ..... 240/54 R, 54 A, 102 B

[56] References Cited

UNITED STATES PATENTS

| | | | |
|---|---|---|---|
| 3,119,568 | 1/1964 | Broder | 240/102 B |
| 3,183,348 | 5/1965 | Porter | 240/54 A |
| 3,536,907 | 10/1970 | Kramer | 240/102 B |
| 3,755,668 | 8/1973 | Moreschini | 240/54 A |
| 3,814,927 | 6/1974 | Buzza | 240/102 B |

*Primary Examiner*—Monroe H. Hayes

*Attorney, Agent, or Firm*—Lawrence I. Field

[57] ABSTRACT

A light guard molded from an electrically non-conductive synthetic resin and including a reflector member and a cage member provided with integrally molded hinge and latch means for retaining the members in latched relation against significant unlatching forces to which the light guard is subjected during use.

11 Claims, 11 Drawing Figures

LIGHT GUARD

BACKGROUND OF THE INVENTION

1. Field of the Invention

The present invention relates to a guard for a light bulb, such as an incandescent light bulb comprising a source of illumination for a trouble light, building exit light, and the like. More particularly, the present invention relates to a light guard substantially molded of synthetic resin.

2. Description of the Prior Art

Light guards such as are normally provided for trouble lights, building exits, etc., have generally been fabricated of metal materials and usually included a reflector element to which a cage member was hingedly secured to permit access to light bulb socket for installation or replacement of a light bulb. In the case of a trouble light a hook is also secured to the reflector to permit hanging of the trouble light in use. Recognizing the dangers inherent in the use of a trouble light, or the like, fabricated of electrically conductive metal materials, lights such as trouble lights have been fabricated from electrically non-conductive synthetic resin. U.S. Pat. No. 3,119,568, issued Jan. 28, 1964, is directed to a trouble light guard molded of a plastic in a one-piece construction. The cage member of such a light is hingedly secured to the reflector element by an integrally molded resilient hinge means, oftentimes referred to as a living hinge and the reflector and cage secured against opening by a latch means including a dimensionally deformable locking tab. As seen in FIGS. 4 and 6 the band portions 34 and 35 are provided with inwardly projecting axially extending ribs 33 to facilitate clamping of the light guard to light bulb socket support means, such as a trouble light handle for example, of various diameters and materials.

Although the prior art trouble light guards of molded synthetic resin are generally satisfactory for the purpose for which they were intended, it has been found that such guards are oftentimes not constructed so as to avoid dangerous displacement of the reflector relative to the cage whereby the cage becomes unlatched. Under such circumstances, there is a high risk of being burned by the hot lamp, or possibly exposing the lamp socket to inadvertent contact with a user's hand.

SUMMARY OF THE INVENTION

The present invention solves problems previously existent in the prior art particularly with regard to light guards of molded synthetic resin, and specifically such guards of one-piece molded construction. The present invention provides a light guard, such as for an extension trouble light, building exit, or other installation requiring a caged reflector light, of molded electrically non-conductive synthetic resin and provided with cage and reflector hinge and latch means for securement thereof under severe use or impact.

Toward these ends, light guards constructed in accordance with the present invention include hinge and latch means constructed so as to resist unwanted unlatching in use.

Lights constructed in accordance with the present invention are also characterized by a minimum of electrically conductive elements since the lights are provided with a molded clamp that requires only self-tapping screws, not bolts and nuts, for securement of the light guard to a lamp base.

In addition, with respect to a trouble light guard constructed in accordance with the present invention, the guard is provided with a swivel hook to permit 360° directional placement of the reflector regardless of the location of the means on which the trouble light guard is hung.

Other features and advantages of the invention will become apparent following the description considered in connection with the accompanying illustrative drawings.

DESCRIPTION OF THE PREFERRED EMBODIMENTS

Figure 1:
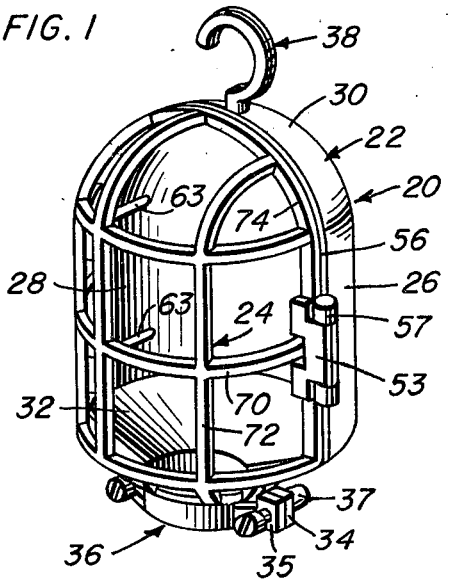
FIG. 1 is a perspective view of a molded trouble light guard comprising one embodiment of the present invention.
Figure 3:
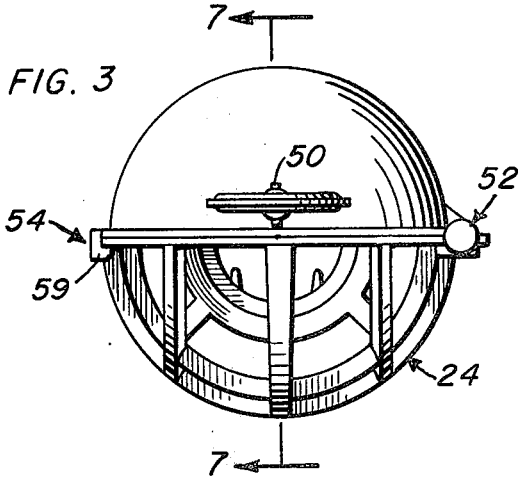
FIG. 3 is a top plan view of the trouble light of FIG. 1.
Figure 4:
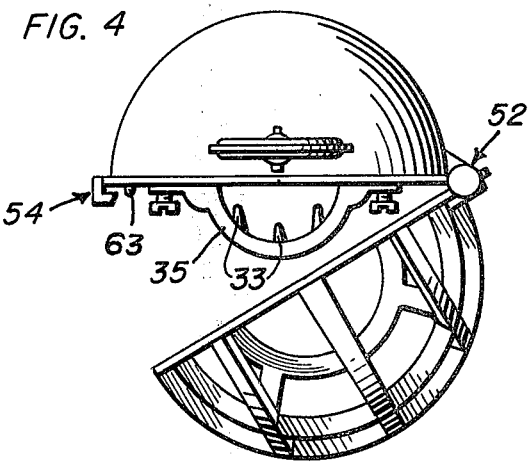
FIG. 4 is a top plan view, similar to FIG. 3 showing the cage member in the open position.
Figure 2:
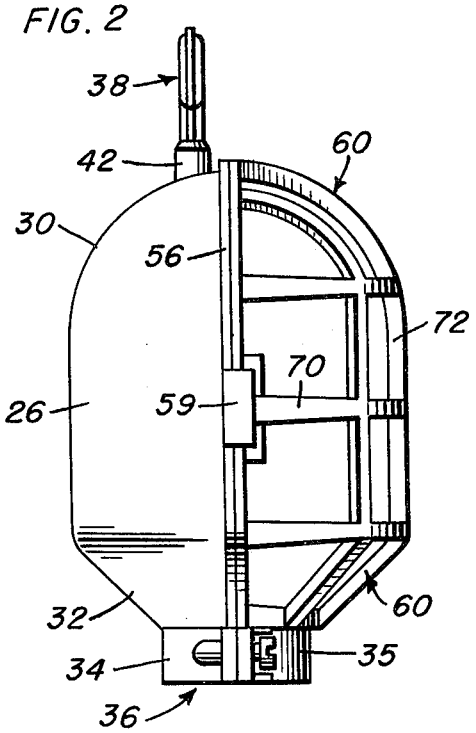
FIG. 2 is an enlarged side elevational view of the trouble light guard of FIG. 1.

Referring now to the drawings, the embodiment of the invention illustrated in FIGS. 1–10 comprises a trouble light guard indicated generally at 20 such as conventionally secured to the upper portion of a lamp socket-handle assembly, not shown. The trouble light guard 20 comprises a reflector member indicated generally at 22 and a cage member indicated generally at 24. The reflector member 22 and the cage member 24, as well as substantially all elements of the light guard described hereinafter are separately molded of an electrically non-conductive synthetic resin material that has sufficient rigidity to withstand dimensional deformation under external forces normally encountered during use. It will be understood that the synthetic resin utilized to form the components of the light guard 20 is sufficiently heat deformation resistant so as to not be adversely effected by the heat and temperatures generated by a light bulb carried by a lamp socket-handle assembly to which the light guard is secured. In this regard, and merely for purposes of setting forth one of numerous suitable synthetic resins, heat resistant polypropylene has been found to be satisfactory for the molding of the components of light guards constructed in accordance with the present invention.

Figure 7:
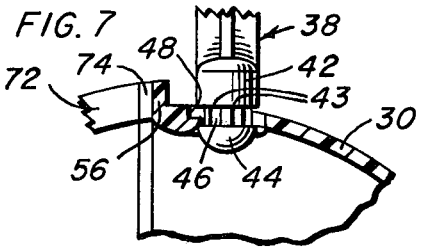
FIG. 7 is an enlarged fragmentary sectional view of a swivel hook securement taken along lines 7—7 in FIG. 3.

The reflector member 22 comprises a body 26, the main body of which is an imperforate semi-cylindrical portion defining a reflecting surface 28. Continuously joined to the semi-cylindrical portion of the body 26 is an upper semi-domed portion 30 and a lower semi-truncated frustro-conical portion 32 which terminates in a semi-circular band 34 integrally joined thereto which comprises a portion of a clamp means, indicated generally at 36 for securing the light guard 20 to a lamp socket-handle assembly. The semi-domed portion 30 carries a swivel hook indicated generally at 38 to enable directional placement of the reflecting surface 28 about 360° of rotation regardless of the orientation of the swivel hook 38 relative to the area to be illuminated. In this regard, as best seen in FIG. 7, the swivel hook 38 includes an arcuate body portion 40 and an elongated cylindrical shank 42 terminating in a hemispherical end portion 44 with an annular groove 46. The domed portion 30 of the reflector member 22 is provided with a generally circular aperture 48 sized so as to rotatably receive, and retain, the reduced diameter portion of the shank 42 of the swivel hook 38. To facilitate rotatable engagement of the hook 38 with the reflector 22, in view of the substantial rigidity of the trouble light guard, the aperture 48 includes a transverse slot 50 to render a localized portion of the dome 30 relatively more resilient so as to enable passage of the hemispherical end portion 44 through the aperture 48 into the rotatably secured position as best seen in FIG. 7. The reflector body 26 has integrally molded therewith one portion of a hinge means indicated generally at 52 and a latch means indicated generally at 54 integrally molded with the reflector body 26 and a generally peripherally extending and radially projecting flange 56 which means comprise significant aspects of light guards constructed in accordance with the present invention. A more detailed description of the hinge and latch means will be provided hereinafter.

Figure 10:
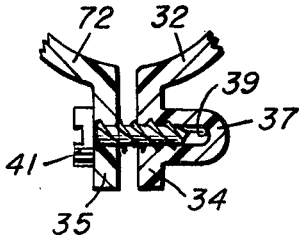
FIG. 10 is an enlarged fragmentary sectional view of a clamp means taken along lines 10—10 of FIG. 6.

The cage member 24 is shown comprising a plurality of arcuate-shaped transversely extending ribs 70 and a plurality of longitudinally extending ribs 72 that define an open grid which blocks very little light while providing protection for a light bulb operatively positioned within the light guard 20. The ribs 70 and 72, in addition to being integrally joined at the intersections thereof, are integrally joined to a radially projecting peripheral flange 74 generally complimentary to the flange 56 of the reflector member 22. The top and bottom of the cage member 24 terminate in domed and frustro-conical portions 58 and 60 respectively, that are complimentary to the portions 30 and 32 of the reflector member 22. As best seen from FIG. 4 the clamp means 36 for securement of the light guard to a lamp base is entirely carried by the reflector member 22 and the semi-circular band portion 34 has removably secured thereto a complimentary semi-circular band portion 35. In this regard the band portion 34 includes integral studs 27, which as best seen in FIG. 10 have a blind bore 39 sized to receive the shank of a self-tapping, self-locking metallic screw 41 which passes through suitable apertures in the band portion 35 and is threadably secured due to the self-tapping action. It will thus be seen that the aforedescribed construction minimizes the metallic components to just the screws 41. It will be appreciated, that if the added expense is not a factor, that within the scope of the construction illustrated, the bore 39 could be prethreaded and a non-self-tapping screw of either metallic or non-metallic nature utilized.

Returning to a more detailed description of the hinge means 52 and the latch means 54 it will be seen best from FIGS. 1, 3, 4 and 5 that the hinge means 52 includes a socket member 53 integrally molded as a part of the cage member 24 and having a longitudinally extending C-shaped slot for the reception of a pintle 55 integral with and extending between end posts 57 integrally molded with the reflector member 22. While the specific aforedescribed structure of the hinge means is illustrative it will be understood that the provision of a socket and pintle hinge is significant in that such construction permits relative rotation of the hinge socket about the axis of the pintle without permitting any significant lateral displacement of the socket and pintle as might effect premature unlatching of a latch means provided to maintain the reflector member 22 and cage member 24 in the latched position. Prior art hinge means, such as integrally molded with both the reflector and cage members can allow lateral displacement of the reflector and cage members with the attendant dangerous unlatching of the reflector and cage members.

Figure 8:
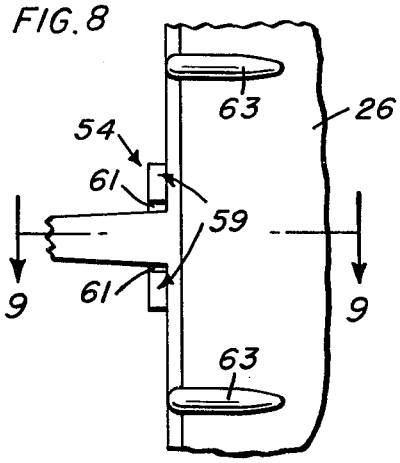
FIG. 8 is an enlarged fragmentary interior elevational view of a portion of a latch means constructed in accordance with the present invention.
Figure 6:
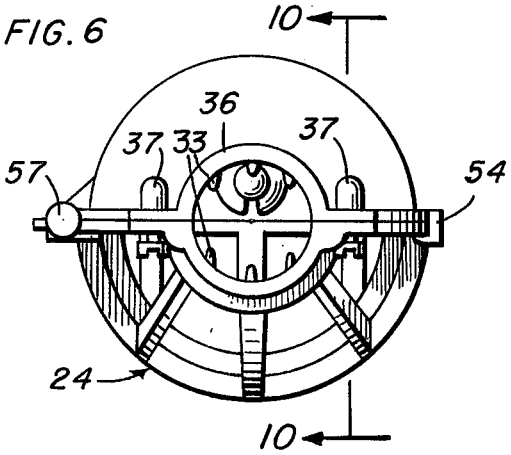
FIG. 6 is a bottom plan view of the trouble light of FIG. 1.
Figure 9:
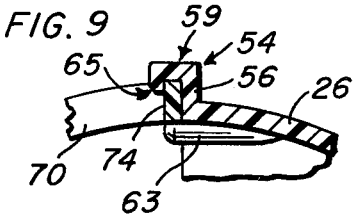
FIG. 9 is a sectional view taken along lines 9—9 of FIG. 8.

The latch means 54 as best seen from FIGS. 3, 4, 8 and 9 includes a latch member indicated generally at 59 comprising an L-shaped member integrally molded with the peripheral flange 56 of the reflector member 22 and configured so as to engage the flange 74 of the cage member 24. In the embodiment 20 shown, one of the ribs 70 may comprise an element of the latch means in that, as seen best in FIGS. 1 and 8 the latch member 59 is provided with a slot extending between the points indicated generally as 61. Thus, the wall portions of the latch member 59 that define the limits of the slot between points 61 provide a portion of a detent means to limit the upward and downward movement of the rib 70 and thus assist in limiting unlatching displacement of the reflector and cage member 22 and 24. The latch means 54 further includes as significant structure to minimize premature unlatching of the reflector and cage members, another detent means indicated generally at 63 to maintain the flange 74 of the cage member 24 within the latch member 59 despite significant radial inward forces applied to the cage member 24. In this regard, as best seen in FIGS. 8 and 9 the inner wall of the reflector body 26 at points spaced upwardly and downwardly from the latch 59 is provided with upstanding cage displacement detent pins 63 that extend sufficiently into the interior of the cage member 24 so as to coact with latch member 59 securely engage the flange 74 in the latched position. It will be seen that to latch the cage 24 relative to the reflector 24 the cage is pivoted about the hinge pintle axis and the flange 74 snapped into the slot defined by the latch member 59, flange 56 and pins 63 by virtue of the flange 74 riding over a chamfered surface 65 of the latch member 59 and urging the latch member away from the pins 63 whereupon the flange snaps securely into the position seen best in FIG. 9. It will be understood that the aforedescribed coaction of the elements of the latch means does not require dimensional deformation of the elements to latch and unlatch but rather requires relative displacement of the elements. Furthermore, in the absence of a chamfered edge for the latched flange 74 to act upon, premature unlatching of the cage is minimized. Considerable manual force is required to unlatch the cage by outward radial displacement of the latch member 59 to allow the flange 74 to clear the latch member 59.

Turning again to FIG. 7, it will be seen that the swivel hook 38 is provided with means for selectively rotatably positioning the hook relative to the reflector member 22. Toward this end, the reduced diameter portion of the shank 42 is provided with a plurality of ribs 43 that coact with the walls of the slot 50. The ribs 43 are sized, and positioned so that they releasably snap into the slot 50 at predetermined degrees of rotation so that in use the reflector 22 may be generally nonrotatably positioned relative to whatever supports the hook 38.

Figure 11:
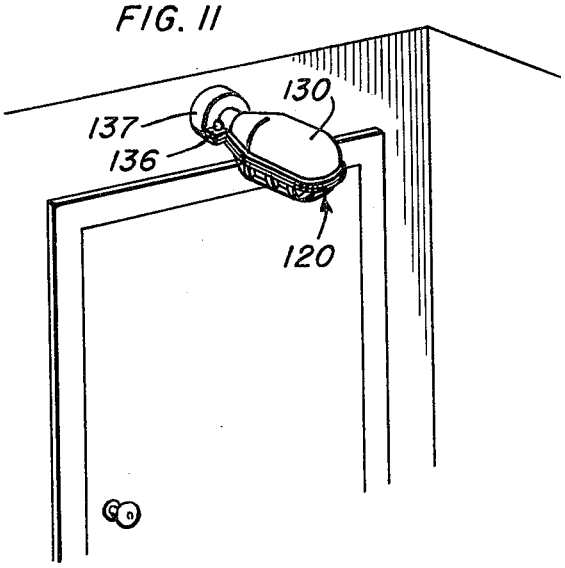
FIG. 11 is a perspective view of another embodiment of a light guard constructed in accordance with the present invention and shown in use as a light guard for a building exit light.
Figure 5:
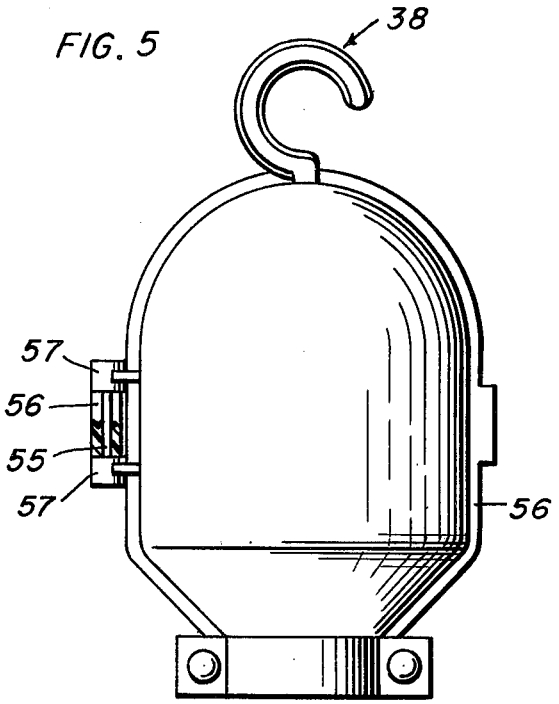
FIG. 5 is a rear elevational view of the trouble light of FIG. 1.

Turning briefly to the embodiment of FIG. 11 where like elements are identified by the addition of 100 to the elements of embodiment 20, it will be appreciated that the light guard indicated generally at 120 therein comprises a guard for a building exit light and that the elements of the light guard, with the exception of the elimination of the swivel hook and the aperture 48 in the domed portion 130 thereof, are substantially identical to the elements comprising the embodiment 20, In FIG. 11 the light guard 120 is shown clamped to the clamp means 136, to an electrical service box 137 secured to the building wall.

It will thus be appreciated that light guards constructed in accordance with the present invention are suitable for numerous applications in addition to the applications illustrated. In addition, the circumferential extent of the reflector portion relative to the circumferential extent of the cage portion is merely for purposes of illustration and could, for example, comprise only cage members and no reflector member without departing from the spirit and scope of the inventive concept.

I claim:

1. A light guard molded of a plastic material and comprising generally complimentary first and second body portions forming a generally cylindrical guard having a generally closed top end and a generally open bottom end, said generally open bottom end including clamp means for removably fixing the light guard to a light bulb socket support means, generally at least one of said body portions comprising a cage member, fixed axis hinge means for hingedly securing said first and second body portions, positive latch means for normally maintaining said first and second body portions in closed relation, and said latch means including detent means for resisting radially inward and axial unlatching deformation of said first body portion relative to said second body portion, said detent means including an axially extending slot of generally C-shaped cross section for reception of a portion of one of said first and second body portions.

2. The light guard of claim 1 wherein said hinge means comprises a socket and pintle hinge.

3. The light guard of claim 1 wherein one of said body portions comprises a reflector.

4. The light guard of claim 1 wherein said detent means includes detent members fixed to one of said first and second body portions for maintaining the other of said first and second body portions in latched relation to a latch member comprising an element of said latching means.

5. The light guard of claim 1 including a hook rotatably secured to one of said first and second body portions.

6. The light guard of claim 5 including means for selectively rotatably positioning said hook relative to said one of said first and second body portions.

7. The light guard of claim 1 wherein said clamp means comprises a first generally semicircular band integrally formed with one of said first and second body portions, a second generally semicircular band, and fastener means for removable securement of said first and second bands.

8. The light guard of claim 7 wherein said fastener means comprises at least one self-tapping threaded fastener passing through at least one aperture provided in one of said band portions, and the other of said band portions being provided with at least one integral stud having a bore sized to permit threaded securement of said at least one threaded fasteners to said at least one stud.

9. The light guard of claim 7 wherein at least one of said first and second generally semicircular bands is provided with means for adapting said clamp means for securement about support means of various diameters and materials.

10. The combination of claim 1 wherein said light guard is a trouble light guard adapted for securement to a light socket-handle assembly.

11. The combination of claim 1 wherein said light guard comprises a light guard for light socket fixed to a structural installation.

* * * * *